US006262003B1

(12) United States Patent
Leonard et al.

(10) Patent No.: US 6,262,003 B1
(45) Date of Patent: Jul. 17, 2001

(54) LIGHT DUTY LIQUID CLEANING COMPOSITIONS COMPRISE AN ALPHA HYDROXY FATTY ACID

(75) Inventors: Isabelle Leonard, Voroux-lez-Liers; Jean Massaux, Olne; Christine Toussaint, Aineffe; Claude Blanvalet, Angleur; Julian Drapier, Seraing, all of (BE)

(73) Assignee: Colgate- Palmolive Company, New York, NY (US)

( * ) Notice: Subject to any disclaimer, the term of this patent is extended or adjusted under 35 U.S.C. 154(b) by 0 days.

(21) Appl. No.: 09/790,198

(22) Filed: Feb. 21, 2001

Related U.S. Application Data

(63) Continuation-in-part of application No. 09/580,252, filed on May 26, 2000, which is a continuation-in-part of application No. 09/316,793, filed on May 21, 1999, now abandoned.

(51) Int. Cl.[7] ..... C11D 17/00

(52) U.S. Cl. ..... 510/238; 510/424; 510/426; 510/505; 510/508

(58) Field of Search ..... 510/238, 424, 510/426, 505, 508

(56) References Cited

U.S. PATENT DOCUMENTS

| | | | | |
|---|---|---|---|---|
| 5,192,460 | * | 3/1993 | Thomas et al. | 252/142 |
| 6,048,834 | * | 4/2000 | Drapier et al. | 510/147 |
| 6,121,228 | * | 9/2000 | Drapier et al. | 510/147 |

* cited by examiner

*Primary Examiner*—Necholus Ogden
(74) *Attorney, Agent, or Firm*—Richard E. Nanfeldt

(57) ABSTRACT

A light duty liquid detergent with desirable cleansing properties to the human skin comprising a $C_{8-18}$ ethoxylated alkyl ether sulfate anionic surfactant, a sulfonate anionic surfactant, optionally, a hydroxy aliphatic acid and water.

5 Claims, No Drawings

LIGHT DUTY LIQUID CLEANING COMPOSITIONS COMPRISE AN ALPHA HYDROXY FATTY ACID

RELATED APPLICATION

This application is a continuation in part application of U.S. Ser. No. 9/580,252 filed May 26, 2000 which in turn is a continuation in part of application of U.S. Ser. No. 9/316,793 filed May 21, 1999 now abandoned.

FIELD OF INVENTION

This invention relates to a light duty liquid cleaning composition which imparts mildness to the skin designed in particular for cleaning dishes and which is effective in removing particular and grease soil in leaving unrinsed surfaces with a shiny appearance.

BACKGROUND OF THE INVENTION

In recent years all-purpose light duty liquid detergents have become widely accepted for cleaning hard surfaces, e.g., dishes, glasses, sinks, painted woodwork and panels, tiled walls, wash bowls, washable wall paper, etc. Such all-purpose liquids comprise clear and opaque aqueous mixtures of water-soluble organic detergents and water-soluble detergent builder salts.

The present invention relates to light duty liquid detergent compositions with high foaming properties, which contain a sulfonate surfactant and, optionally, a hydroxy aliphatic acid.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

SUMMARY OF THE INVENTION

It has now been found that a light duty liquid detergent can be formulated with an anionic surfactant which has desirable cleaning properties and mildness to the human skin.

An object of this invention is to provide a light duty liquid detergent composition which comprises a sulfate and/or sulfonate anionic surfactant and, optionally, a hydroxy aliphatic acid, wherein the instant compositions do not contain an amine oxide surfactant, a betaine surfactant, an alkyl polyglucoside surfactant, an N-alkyl aldonamide, choline chloride or buffering system which is a nitrogenous buffer which is ammonium or alkaline earth carbonate, guanidine derivates, alkoxylalkyl amines and alkyleneamines $C_3$–$C_7$ alkyl and alkenyl monobasic and dibasic acids such as $C_4$–$C_7$ aliphatic carboxylic diacids which do not contain a hydroxy group, phosphoric acid, amino alkylene phosphonic acid and the composition is pourable and is not a gel and the composition has a complex viscosity at 1 rads-1 of less than 0.4 Pascal seconds.

Another object of this invention is to provide a light duty liquid detergent with desirable high foaming and cleaning properties.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

The light duty liquid compositions of the instant invention comprise approximately by weight:

(a) 10% to 55%, more preferably 12% to 48% of a mixture of an alkali metal salt of an anionic sulfonate surfactant or an anionic sulfonic acid and an alkali metal salt of a $C_8$–$C_{18}$ ethoxylated alkyl ether sulfate and/or a $C_8$–$C_{18}$ alkyl ether sulfate, wherein the weight ratio of the sulfonate surfactant to the sulfate surfactant is from 15:1 to 1:1;

(b) 0 to 10%, more preferably 0.1% to 8% of an ethoxylated nonionics surfactant;

(c) 0.1% to 1%, more preferably 0.1% to 0.8% of a perfume, terpene or essential oils;

(d) 0.1% to 5% of a polyethylene glycol;

(e) 0 to 8%, more preferably 0.1% to 6% of an inorganic magnesium salt;

(f) 0 to 10% of a solubilizer;

(g) 0 to 5% of a hydroxy aliphatic acid; and (h) the balance being water.

The instant compositions do not contain an amine oxide surfactant, $C_1$–$C_6$ alkyl ethers and esters of ethylene glycol and/or propylene glycol, a betaine surfactant, an alkyl polyglucoside surfactant, an N-alkyl aldonamide, choline chloride or buffering system which is a nitrogenous buffer which is ammonium or alkaline earth carbonate, guanidine derivates, alkoxylalkyl amines and alkyleneamines $C_3$–$C_7$ alkyl and alkenyl monobasic and dibasic acids such as $C_4$–$C_7$ aliphatic carboxylic diacids which do not contain a hydroxy group, phosphoric acid, amino alkylene phosphonic acid and the composition is pourable and is not a gel and the composition has a complex viscosity at 1 rads-1 of less than 0.4 Pascal seconds.

The anionic sulfonate surfactants which may be used in the composition of this invention at a concentration of 8 to 36 wt. %, preferably 12 to 30 wt. % are water soluble and include the sodium, magnesium, potassium, ammonium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms and $C_8$–$C_{18}$ alkyl sulfates and mixtures thereof. The preferred anionic sulfonate surfactant is a $C_{12-18}$ paraffin sulfonate.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The $C_{8-18}$ ethoxylated alkyl ether sulfate surfactants or alkyl sulfate surfactants are used at a concentration of 2 to 20 wt. %, more preferably 4 to 16 wt. %. The $C_8$–$C_{18}$ alkyl ether sulfate surfactants have the structure $$R—(OCHCH_2)_nOSO_3^-M^{30}$$

wherein n is about 1 to about 22 more preferably 1 to 3 and R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 2 to about 15 wt. %

The compositions of the present invention may contain a nonionic surfactant or mixtures thereof. Suitable nonionic surfactants for use herein are fatty alcohol ethoxylates which are commercially available with a variety of fatty alcohol chain lengths and a variety of ethoxylation degrees. Indeed, the HLB values of such nonionic surfactants depend essentially on the chain length of the fatty alcohol and the degree of ethoxylation. Particularly suitable nonionic surfactants are the condensation products of a higher aliphatic alcohol containing about 8 to 18 carbon atoms in a straight or branched chain configuration, condensed with about 2 to 30 moles of ethylene oxide.

The hydroxy aliphatic acid which is optionally used in the composition at a concentration of about 0 to about 5 wt. %, more preferably about 0.05 wt. % to about 4 wt %. The hydroxy aliphatic acid used in the instant composition is selected from the group consisting of glycolic acid, salicylic acid, tartaric acid, citric acid and lactic acid and mixtures thereof.

The polyethylene glycol used in the instant composition has a molecular weight of 200 to 1,000, wherein the polyethylene glycol has the structure $$HO(CH_2CH_2O)_nH$$

wherein n is 4 to 25. The concentration of the polyethylene glycol in the instant composition is 0.1 to 5 wt. %, more preferably 0.25 wt. % to 4 wt. %.

The instant light duty liquid nonmicroemulsion compositions contain about 0 wt. % to about 10 wt. %, more preferably about 1 wt. % to about 8 wt. %, of at least one solubilizing agent selected from the group consisting of a $C_{2-5}$ mono, dihydroxy or polyhydroxy alkanols such as ethanol, isopropanol, glycerol ethylene glycol, diethylene glycol and propylene glycol and mixtures thereof and alkali metal cumene or xylene sulfonates such as sodium cumene sulfonate and sodium xylene sulfonate. The solubilizing agents are included in order to control low temperature cloud clear properties.

The instant compositions explicitly exclude alkali metal silicates and alkali metal builders such as alkali metal polyphosphates, alkali metal carbonates and alkali metal phosphonates because these materials, if used in the instant composition, would cause the composition to have a high pH as well as leaving residue on the surface being cleaned.

The final essential ingredient in the inventive compositions having improved interfacial tension properties is water. The proportion of water in the compositions generally is in the range of 35% to 90%, preferably 50% to 85% by weight of the composition.

In addition to the above-described essential ingredients required for the formation of the compositions, the compositions of this invention may often and preferably do contain one or more additional ingredients which serve to improve overall product performance.

One such ingredient is an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level.

Thus, depending on such factors as the pH of the system, the nature of the surfactants, and so on, as well as the availability and cost factors, other suitable polyvalent metal ions include aluminum, copper, nickel, iron, calcium, etc. It should be noted, for example, that with the preferred paraffin sulfonate anionic detergent calcium salts will precipitate and should not be used. It has also been found that the aluminum salts work best at pH below 5 or when a low level, for example 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. For example, for each gram-ion of Mg++ there will be 2 gram moles of paraffin sulfonate, alkylbenzene sulfonate, etc., while for each gram-ion of $A1^{3+}$ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic surfactant. At higher concentrations of anionic surfactant, the amount of the inorganic magnesium salt will be in range of 0.1 to 5 wt. %, more preferably 0.25 to 3 wt. %.

The liquid cleaning composition of this invention may, if desired, also contain other components either to provide additional effect or to make the product more attractive to the consumer. The following are mentioned by way of example: Colors or dyes in amounts up to 0.5% by weight; vinegar, preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the instant compositions exhibit stability at reduced and increased temperatures. More specifically, such compositions remain clear and stable in the range of 5° C. to 50° C., especially 10° C. to 43° C. Such compositions exhibit a pH of 3 to 7.0. The liquid compositions are readily pourable and exhibit a viscosity in the range of 6 to 400 milliPascal. second (mPas.) as measured at 25° C. with a Brookfield RVT Viscometer using a #2 spindle rotating at 50 RPM.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing procedure:

| | A | B | C | D | E | F | G | H | I | J |
|---|---|---|---|---|---|---|---|---|---|---|
| C10–C14 alkyl benzene sulfonic acid | | | | | | | 27 | 27 | 14.7 | 16.2 |
| Triethanolamine | | | | | | | 14.7 | 14.7 | 3.47 | 3.6 |
| $C_{14-16}$ Paraffin sulfonate sodium salt | 21.33 | 25 | 17.33 | 25 | 14.8 | 9.1 | | | | |
| $C_{13-14}$ AEOS 2:1 EO | 10.67 | 4 | 8.67 | 4 | 12.2 | 7.5 | 8.86 | 8.86 | 4.83 | 5.3 |
| Dibutyl adipate | | | 5 | | | | | | | |
| Polyethylene glycol MN300 | 1.5 | 1 | | 1 | 1 | 0.6 | 2 | 2 | 1.1 | 1.1 |
| Nonionic 91-8 | | 4.5 | | 4.5 | | | | | | |
| Sodium cumene sulfonate | | | 1.2 | | | | | | | |
| MgSO4 7H2O | 2 | 1 | | 1 | 2 | 1 | 6 | 6 | 3.3 | 4 |
| Lactic acid | 2 | 2 | | | | | 1.6 | | 1.6 | |
| Citric acid | | | 1 | | | | | 0.07 | | |
| Thickener (e.g. Acusol 820) | | 0.3 | 0.3 | | | | | | | |
| Perfume | 0.25 | 0.25 | 0.25 | 0.55 | 0.4 | 0.24 | 0.43 | 0.4 | 0.3 | 0.3 |
| Ethanol | | | | | | | 1.9 | 1.9 | 1.4 | 1.4 |
| Ethylene diamine tetraacetic acid | 0.045 | 0.045 | | 0.045 | 0.062 | 0.045 | | 0.083 | | 0.078 |
| Dipropylene glycol monomethyl ether | 1 | | 2 | | | | | | | |
| Sodium chloride | | | | | | 2.5 | | | | |
| Sodium hydroxyde | | | | | | | | | 1 | 1.2 |
| Water | Bal. | Bal. | Bal. | Bal | Bal | Bal | Bal | Bal | Bal | Bal |
| Appearance @ RT | clear | clear | clear | clear | clear | clear | clear | clear | clear | clear |
| Appearance @ 4 C. | clear | clear | clear | clear | clear | clear | clear | clear | clear | clear |
| pH | 3.5 | 3.5 | 4.0 | 6.0 | 6.0 | 6.0 | 3.5 | 5.5 | 3.5 | 6.5 |

EXAMPLE 2

The following compositions in wt. % were prepared by simple mixing procedure:

| | A | B |
|---|---|---|
| $C_{14-16}$ Paraffin sulfonate sodium salt | 12.5 | 12.5 |
| $C_{13-14}$ AEOS 2:1 EO | 6 | |
| Triethanolaminelaurylsulfate | | 6 |
| NaCl | 2.5 | 3.5 |
| Nonionic 91-8 | 1 | 1 |
| Lactic acid | | |
| Citric acid | 1 | 0.8 |
| Perfume | 0.25 | 0.25 |
| Water | Bal. | Bal. |
| Appearance @ RT | clear | clear |
| Appearance @ 4 C. | clear | clear |
| pH | 3.0 | 3.0 |

EXAMPLE 3

The following compositions in wt. % were prepared by simple mixing procedure:

| | A | B | C |
|---|---|---|---|
| $C_{14-16}$ Paraffin sulfonate sodium salt | 19.3 | | |
| $C_{13-14}$ AEOS 2:1 EO | 9.7 | | 6.5 |
| Dibutyl adipate | 6 | | |
| Polyethylene glycol MN300 | | | 6 |
| Nonionic 91-8 | | 5.25 | |
| Sodium lauryl sulfate | | 1.75 | |
| Linear alkyl benzene sulfonate | | 21 | 19.5 |
| Lactic acid | | | |
| Citric acid | 1 | 2 | 1 |
| Limonene | | 6 | 6 |
| Perfume | 0.25 | 0.25 | 0.25 |
| Dipropylene glycol monomethyl ether | 7 | 8 | |
| Water | Bal. | Bal. | Bal. |
| Appearance @ RT | clear | clear | clear |
| Appearance @ 4 C. | clear | clear | clear |
| pH | 4.0 | 3.5 | 3.0 |

What is claimed:

1. A clear light duty liquid cleaning composition which comprises approximately by weight:

(a) 10% to 55% of a mixture of an alkali metal salt of an anionic sulfonate surfactant or an anionic sulfonic acid and an alkali metal salt of a $C_8$–$C_{18}$ ethoxylated alkyl ether sulfate and/or a $C_8$–$C_{18}$ alkyl ether sulfate, wherein the weight ratio of the sulfonate surfactant to the sulfate surfactant is from 15:1 to 1:1;

(b) 1 to 10% of an ethoxylated nonionic surfactant;

(c) 0.1% to 5% of a polyethylene glycol;

(d) 0.05 to 5% of a hydroxy aliphatic acid selected from the group consisting of citric acid and latic acid and mixtures thereof;

(e) 1 to 10% of a solubilizer;

(f) 0.1 to 8% of an inorganic magnesium salt; and (g) the balance being water, wherein the composition does not contain a $C_8$–$C_{18}$ alkyl or alkenyl monobase or dibasic acid which does not contain a hydroxy group, phosphoric acid or an amino alkylene phosphonic acid.

2. The composition of claim 1, wherein said solubilizing agent is selected from the group consisting of sodium, potassium, ammonium salts of cumene, xylene and toluene sulfonate and mixtures thereof.

3. The composition of claim 1, wherein said solubilizing agent is sodium cumene sulfonate.

4. The composition of claim 1, wherein said solubilizing agent is selected from the group consisting of isopropanol, ethanol, glycerol, ethylene glycol, diethylene glycol and propylene glycol and mixtures thereof.

5. The composition of claim 1, further including vinegar.

* * * * *

UNITED STATES PATENT AND TRADEMARK OFFICE

CERTIFICATE OF CORRECTION

PATENT NO. : 6,262,003 B1
DATED : July 17, 2001
INVENTOR(S) : Leonard, IsAbelle et al.

It is certified that error appears in the above-identified patent and that said Letters Patent is hereby corrected as shown below:

Title page,
Inventors Name: should read "Julien Drapier"

Signed and Sealed this

Twenty-ninth Day of January, 2002

*Attest:*

*Attesting Officer*

JAMES E. ROGAN
*Director of the United States Patent and Trademark Office*